US008764134B2

(12) United States Patent
Salice

(10) Patent No.: US 8,764,134 B2
(45) Date of Patent: Jul. 1, 2014

(54) DEVICE FOR OPENING AND CLOSING A MOVABLE PART OF A FURNITURE UNIT

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 118 days.

(21) Appl. No.: 13/127,424

(22) PCT Filed: Dec. 7, 2009

(86) PCT No.: PCT/EP2009/008713

§ 371 (c)(1),
(2), (4) Date: May 3, 2011

(87) PCT Pub. No.: WO2010/066393

PCT Pub. Date: Jun. 17, 2010

(65) Prior Publication Data

US 2011/0210653 A1 Sep. 1, 2011

(51) Int. Cl.
*A47B 95/00* (2006.01)

(52) U.S. Cl.
USPC ..... 312/333; 312/319.1

(58) Field of Classification Search
USPC ..... 312/319.1, 333, 334.6, 334.44–334.47
See application file for complete search history.

(56) References Cited

U.S. PATENT DOCUMENTS

| | | | | |
|---|---|---|---|---|
| 5,364,179 | A * | 11/1994 | Brustle et al. | 312/333 |
| 7,028,370 | B2 * | 4/2006 | Hoshide et al. | 16/96 R |
| 7,244,005 | B1 * | 7/2007 | Lu | 312/333 |
| 7,748,799 | B2 * | 7/2010 | Kleinsasser | 312/319.1 |
| 2006/0238089 | A1 * | 10/2006 | Prentner et al. | 312/333 |
| 2007/0222346 | A1 | 9/2007 | Kleinsasser | |
| 2009/0273263 | A1 * | 11/2009 | Berger | 312/334.1 |
| 2011/0156561 | A1 * | 6/2011 | Salice | 312/319.1 |
| 2011/0254416 | A1 * | 10/2011 | Salice | 312/319.1 |

FOREIGN PATENT DOCUMENTS

| | | | |
|---|---|---|---|
| DE | 19935120 | | 2/2001 |
| WO | WO2005/012678 | | 2/2005 |
| WO | WO2006/066774 | * | 6/2006 |

OTHER PUBLICATIONS

International Search Report in International application No. PCT/EP2009/008713, dated Mar. 4, 2010.
Written Opinion of the International Search Authority in International application No. PCT/EP2009/008713, dated Mar. 4, 2010.
Request for early entry into European Phase filed in International application No. PCT/EP2009/008713, dated Oct. 20, 2010.
Communication pursuant to Article 94(3) EPC from the European Patent Office for European National Phase Application No. 09764741.6, dated Mar. 3, 2011.

* cited by examiner

*Primary Examiner* — Matthew Ing
(74) *Attorney, Agent, or Firm* — Fitch, Even, Tabin & Flannery LLP

(57) ABSTRACT

The device for opening and closing a movable part of a furniture unit comprises a body (108), associated with a fixed part of the furniture unit (116), for supporting a slider (3) reversibly sliding along a sliding axis (100) in contrast and due to the action of a first spring (5), the slider being engageable with a drawing device provided on a drawing element (105) slidable in the direction of the sliding axis with an integral or reversibly couplable connection to the movable part (103) of the furniture unit, the supporting body comprising a first displacement device suitable for moving the drawing device so as to release the drawing device and the slider from their mutual engagement, an elastically yielding stop element against which the drawing element abuts directly or indirectly before engaging with the drawing device in the first displacement device.

14 Claims, 5 Drawing Sheets

DEVICE FOR OPENING AND CLOSING A MOVABLE PART OF A FURNITURE UNIT

CROSS REFERENCE TO RELATED APPLICATIONS

This application is a U.S. national phase application of International Application No. PCT/EP2009/008713, filed Dec. 7, 2009, which claims benefit from Italian Application No. MI2008A002196, filed Dec. 12, 2008, both of which are hereby incorporated herein by reference in their entirety.

The present invention refers to a device for opening and closing a movable part of a furniture unit. It is common knowledge that there have been devices on the market for some time now that achieve the virtually automatic opening and/or closing of movable parts of furniture units, such as a door or a drawer in a furniture unit.

For example, to open a drawer in a furniture unit, a device called a ratchet is currently used, which substantially comprises thrust means that are released by exerting a mild pressure on the drawer and, when released, under an elastic force they confer a thrust on the drawer that determines its controlled displacement, thereby enabling the user to grasp the drawer and open it completely, especially in the case of drawers without handles.

Conversely, to close the drawer, a self-closing device is used that is normally associated with the fixed drawer guide and consists of a body for supporting a slider that is movable inside a groove provided in said body, between two stable terminal positions.

The slider normally moves inside the groove in contrast and due to the action of a spring that is activated by drawing means integrally attached to the withdrawable drawer guide.

The opening of the drawer determines the activation of the self-closing device, which takes over, when the drawer is closed again, in the final stretch of its stroke—by means of a pin, for instance—returning it to the completely closed position due to the effect of the spring.

Cooperating with the self-closing device, there is normally also a decelerator that absorbs the closing force of the drawer, attenuating the shock that would occur due to the effect of the drawer's closing spring.

In the light of the above considerations, it is easy to perceive the complexity inherent in the need to be able to combine an automated opening system with a self-closing system governing the movable part of a furniture unit, since the forces involved in the ratchet and in the self-closing device normally tend to contrast with one another, preventing either the opening or the closing action.

For these reasons, sometimes extremely complex systems have been conceived that also exploit parts driven by electric motors for the purpose, in order to be able to compensate for the forces involved and enable a virtually automatic (albeit only partial) opening and closing of the movable part of a furniture unit. Such solutions are sometimes scarcely effective, however, because in addition to making the device extremely complex, they easily tend to fail to assure a constant efficiency over time, they need regular maintenance and they entail high costs, making their application unsuitable for certain types of furniture. When the movable part consists of a drawer, the self-closing device can be arranged indifferently in various positions in relation to the furniture unit, e.g. in line with guides that enable its movement. In the case of doors swinging by means of hinges, on the other hand, the device should preferably be located on the part of the furniture unit opposite to the one where the hinges are located, i.e. where it is possible, by means of a pressure exerted from the outside by the user, to obtain a displacement of the door sufficient to enable the device. The door is opened by completely separating its edge from the side of the furniture unit against which it abuts, with a consequently more complicated interaction between the drawing means and the slider of the self-closing system.

Moreover, there are various different types of hinge commercially available, some in particular in which an elastic device is integrated for providing the thrust in the door-closing direction, possibly assisted by a decelerator device, or fitted with an elastic device for inducing a thrust in the door-opening direction, possibly for associating with the previously-described ratchet devices.

The technical aim of the present invention is consequently to produce a device for opening and closing a movable part of a furniture unit that enables the technical drawbacks of the known art to be overcome. In the context of this technical aim, one object of the invention is to produce a device for opening and closing a movable part of a furniture unit that is reliable and of extremely straightforward functional design, guaranteeing its long-term efficiency without the need for any type of ordinary or extraordinary maintenance to achieve this end. Another object of the invention is to produce a device for opening and closing a movable part of a furniture unit that can be installed without difficulty even by unskilled personnel, consequently also enabling its replacement or adjustment by the user if necessary, and that, among other things, has a limited cost, which can facilitate its diffusion on the market.

Another, not necessarily last object of the invention is to produce a device for opening and closing a movable part of a furniture unit that can be installed on any type of furniture unit, occupying a limited amount of space.

The above technical aim, and these and other objects according to the present invention are achieved by a device for opening and closing a movable part of a furniture unit according to claim 1 below.

The device according to the invention can generally be attached to movable parts of furniture units, including drawers, for instance, but it is particularly suitable for opening doors swinging around a vertical or horizontal axis. The closing of the movable parts of furniture units is instead preferably assisted by or entrusted to known closing devices integrated in the normal guides or hinges with which these parts are provided to enable their movement.

Other characteristics of the present invention are stated, moreover, in the dependent claims.

Further characteristics and advantages of the invention will emerge more clearly from the description of preferred, but not exclusive embodiments of the device for opening and closing a movable part of a furniture unit according to the invention, shown as a non-limiting example in the attached drawings, wherein.

Figure 1:
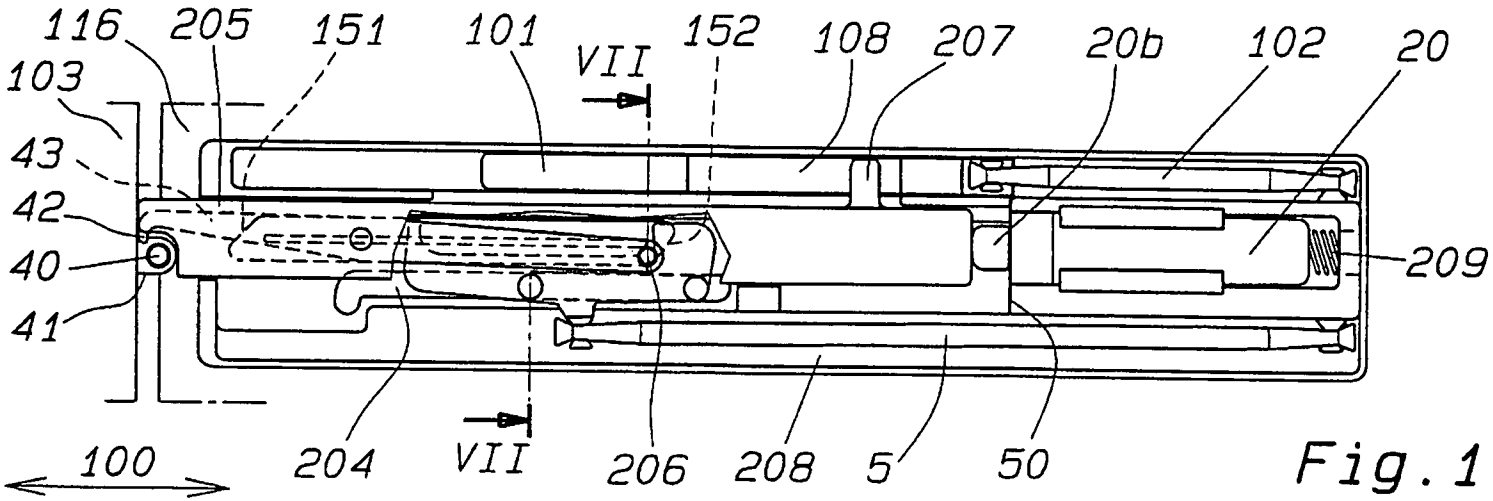
FIG. 1 shows a view from above of the device according to a first preferred embodiment of the present invention with the drawing means in the initial position, with the door closed.

In the various embodiments, equivalent parts are identified by the same numerical references.

With reference to the above-mentioned figures, a device for opening and closing a movable part of a furniture unit according to the invention is shown, globally indicated by the reference number 1.

The movable part 103 of the furniture unit to which reference is made herein, in this specific preferred embodiment, is a door swinging in relation to the body of a furniture unit, but more in general it might equally be the front of a drawer or other such parts.

The device 1 comprises a body 208, associated with the fixed part of the furniture unit 116, for supporting a slider 3 reversibly sliding along a sliding axis 100 in contrast and due to the action of first elastic mean, and in particular of a spring 5. More precisely, the slider 3 is slidingly engaged in a groove 204 in the supporting body 208 that extends in the direction of the sliding axis 100, and that is engageable with drawing means installed on a drawing element 205 sliding in the direction of the sliding axis 100 and integral or reversibly couplable with the movable part 103 of the furniture unit. In particular, the drawing element 205 is slidingly supported inside a guide element 114 provided in a cover element 215 on the supporting body 208.

The drawing element 205 extends longitudinally in the direction of the sliding axis 100 and has a "C"-shaped cross-section.

The supporting body 208 comprises first displacement means suitable for moving the drawing means so as to release said drawing means and the slider 3 from their mutual engagement.

The drawing means are advantageously supported by the drawing element 205 so that they are movable transversely to the direction of the sliding axis 100.

In particular, the drawing means comprise a drawing pin 206 attached to a lever 43 that is hinged at 44 to the drawing element 205 so as to enable a swinging action.

With reference to the embodiment shown in FIGS. 1-11, on the arm opposite to the drawing pin 206, the lever 43 carries an element 42 for mechanically hooking to the movable part 103, e.g. by means of an element 41 attached to the movable part 103 and provided with two flanges that hold a cross pin 40 hooked up by the hooking element 42.

Figure 12:
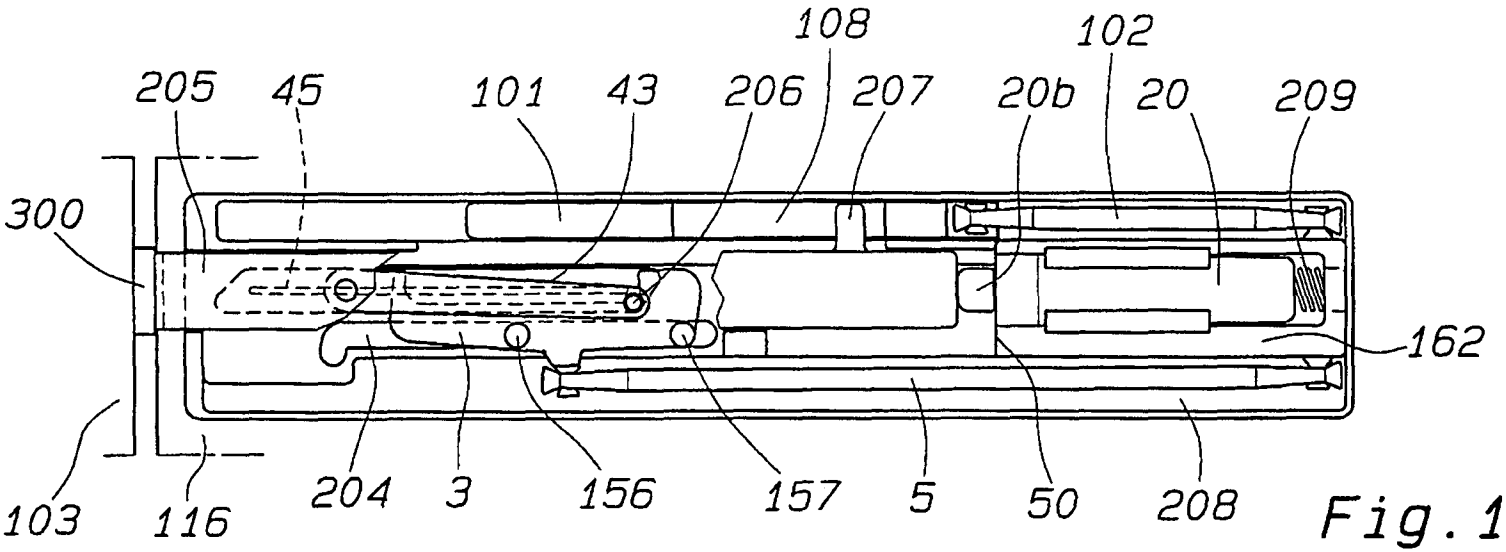
FIG. 12 shows a view from above of the device according to a second preferred embodiment of the present invention, with the drawing element in the initial position and the door closed.
Figure 13:
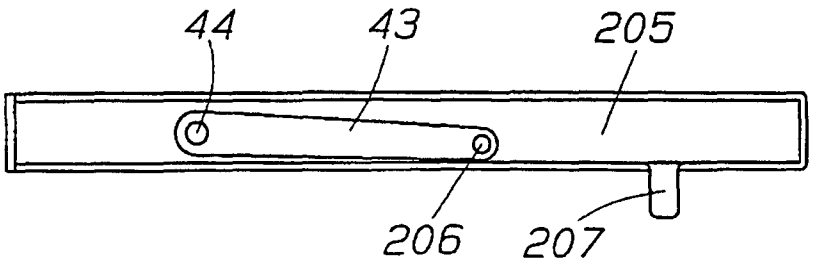
FIG. 13 shows a view from above of the drawing element of the device in FIG. 12.

FIGS. 12 and 13 show a second embodiment of the invention that essentially differs from the first only in terms of the structure of the drawing element 205, in that the system for hooking up the movable part 103 is of magnetic type.

In this case, the lever 43 is a simple lever with the drawing pin 206 fitted at its free end. The magnetic element 300 can be carried by the movable part 103, or by the front end of the drawing element 205.

From now on, reference is made once again to both the preferred embodiments of the invention.

The supporting body 208 includes a track 45 along which the free end of the drawing pin 206 is guided.

The first displacement means, consisting of at least one first stretch 151 and one second stretch 152 of the track 45, extend in a sloping manner transversely to the direction of the sliding axis 100 and they are connected by a third stretch 153 and a fourth stretch 154 of said track that extend parallel to the direction of the sliding axis 100.

In particular, the track 45 comprises two adjacent parallel rails that extend along a closed path with a quadrangular shape.

The first embodiment of the present invention enables the mechanical control of the engagement and disengagement of the device 1 to and from a movable part 103 of a furniture unit using the track 45 provided for the drawing pin 206, and it is preferable to the second embodiment of the present invention because it avoids the need to use magnetic couplings, which are less reliable and noisier.

In its front end portion, the groove 204 comprises second means for displacing the slider 3 transversely to the sliding axis 100, and suitable for engaging in a releasable manner with means for guiding the slider 3.

The second displacement means comprise a front bend 155 in the groove 204, while the guide means comprise a front guide pin 156 and a rear guide pin 157, carried permanently by the slider 3 and slidingly inside the groove 204.

The slider 3 also comprises a recessed surface 158, limited by a front edge 159 and a rear edge 160 for intercepting the drawing pin 206, with a rear cavity 161, where the drawing pin 206 is releasably engageable.

In the present embodiment of the invention, in which the device 1 is attached to a furniture unit fitted with hinges that exert a thrust in the direction for closing the movable part 103, there is also a second slider 101 carried by the supporting body 208 and reversibly movable in the direction of the sliding axis 100 in contrast and due to the action of second elastic means, and particularly of a second spring 102. The second slider 101 is engageable with second drawing means provided on the drawing element 205.

The second drawing means comprise a fin 207 that extends laterally from the drawing element 205 and engages slidingly in a guiding slot 108 provided in the second slider 101.

The device 1 also includes an elastically yielding stop element 209 against which the drawing element 205 abuts directly or indirectly before it engages with the drawing means in the first displacement means, and it may be fitted with thrust means that push the drawing element in the opening direction.

These thrust means preferably push the drawing element 205 only over one stretch of its displacement stroke.

The thrust means comprise an ejector contained in the supporting body 208 to the rear of the drawing element 205. The ejector includes a portion 20 for accommodating a stem **20*b* that is movable in the direction of the sliding axis 100 in contrast and due to the action of a spring (not shown) and it is designed to take effect on the rear base of the drawing element 205** to generate an initial opening stroke of the movable part 103 with a greater force than is exerted thereon by any independent closing devices, such as those integrated in the hinges, for instance.

Figure 6:
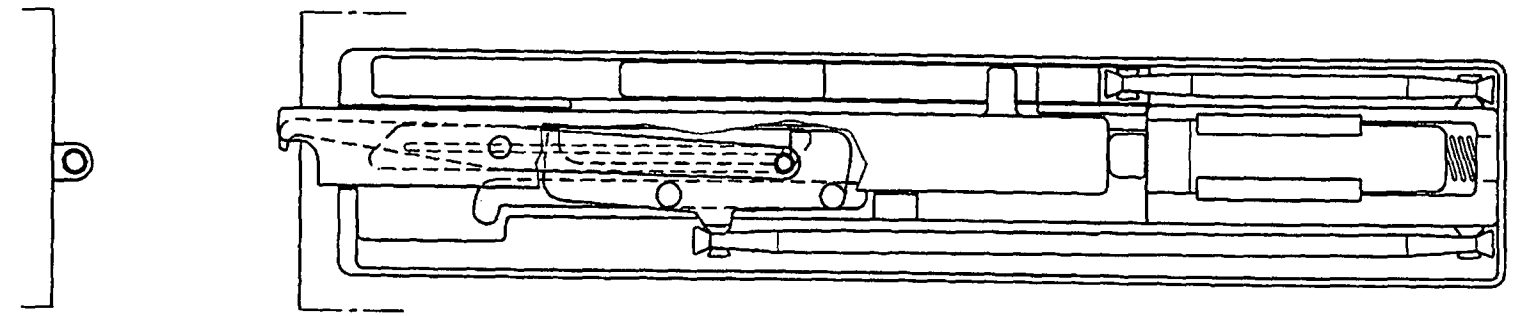
FIG. 6 shows the device in FIG. 1 that, with the door open, has the drawing element in the initial position once again.
Figure 7:
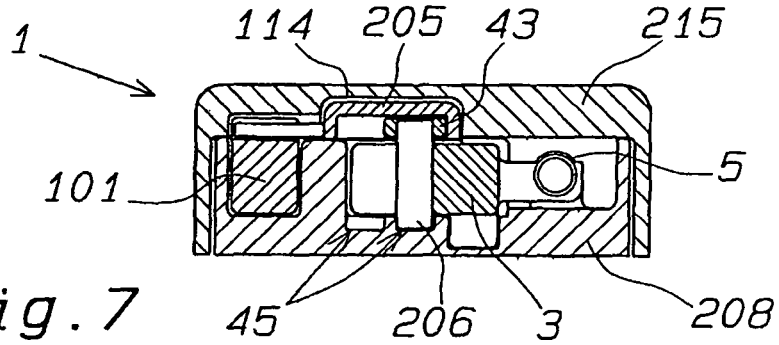
FIG. 7 shows a cross-sectional view of the device in FIG. 1 along line 7-7.
Figure 8:
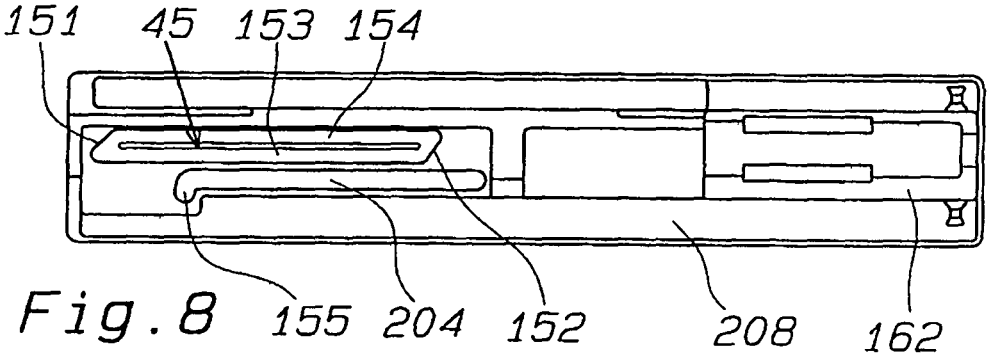
FIG. 8 shows a view from above of the body for supporting the device shown in FIG. 1.
Figure 9:
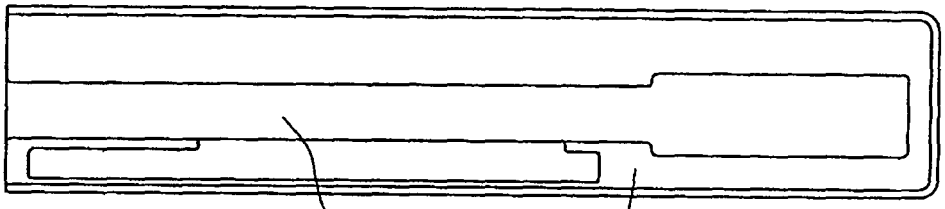
FIG. 9 shows a view from above of the inside of the cover for the box-shaped body of the device in FIG. 1.
Figure 10:
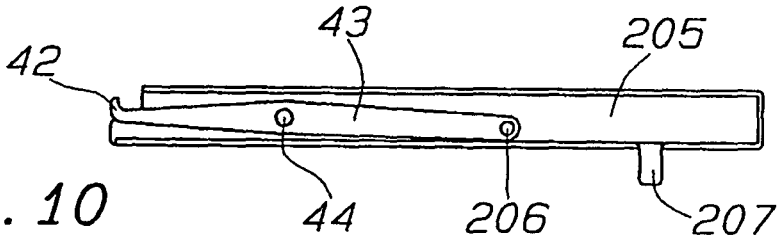
FIG. 10 shows a view from above of the drawing element of the device in FIG. 1.
Figure 11:
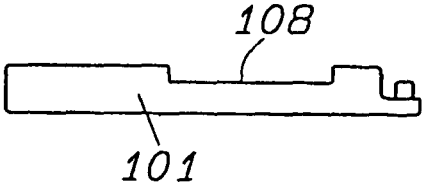
FIG. 11 shows a side view of the second slider of the device in FIG. 1.

In any case, the ejector has a force of expulsion that is weaker than the elastic force of the first elastic means so that, when the slider 3 is free to slide, the latter are able to bring the drawing element 205, with which the slider 3 engages, into the position corresponding to the closed position of the movable part 103 (FIG. 6).

In the embodiments illustrated, the drawing element 205 consequently abuts indirectly against the stop element 209, i.e. with the interposition of the ejector that, in the closed position, has its stem 20*b* completely withdrawn inside the portion 20, thus forming a rigid unit.

The portion 20 of the ejector is pushed by the elastically yielding stop element 209 against a fixed stop element 50 on the supporting body 208 with a greater force than is exerted by the first elastic means, so that it can withdraw in the direction of the sliding axis 100 under the effect of an external action contrasting the elastically yielding stop element 209, that in the case in point is a spring interposed between the rear base of the portion 20 and the bottom wall of the fixed guide 162 along which the portion 20 is movable. The operation of the device according to the invention emerges clearly from the above description and illustrations, and with reference to the first preferred embodiment in particular, it is substantially as follows.

In the first phase, in which the movable part 103 is closed and abuts against the drawing element 205, the drawing pin 206 engages in the rear cavity 161 of the slider 3, that is retained in a position at rest in which the drawing element 205 abuts against the stem 20*b* of the ejector, which in turn abuts against the elastically yielding stop element 209, which is not compressed, but only preloaded so as to retain the ejector in position against the fixed stop element 15. The stem 20*b* is in a withdrawn position, since the force of the ejector 20 is weaker than the force of the spring 5.

Figure 2:
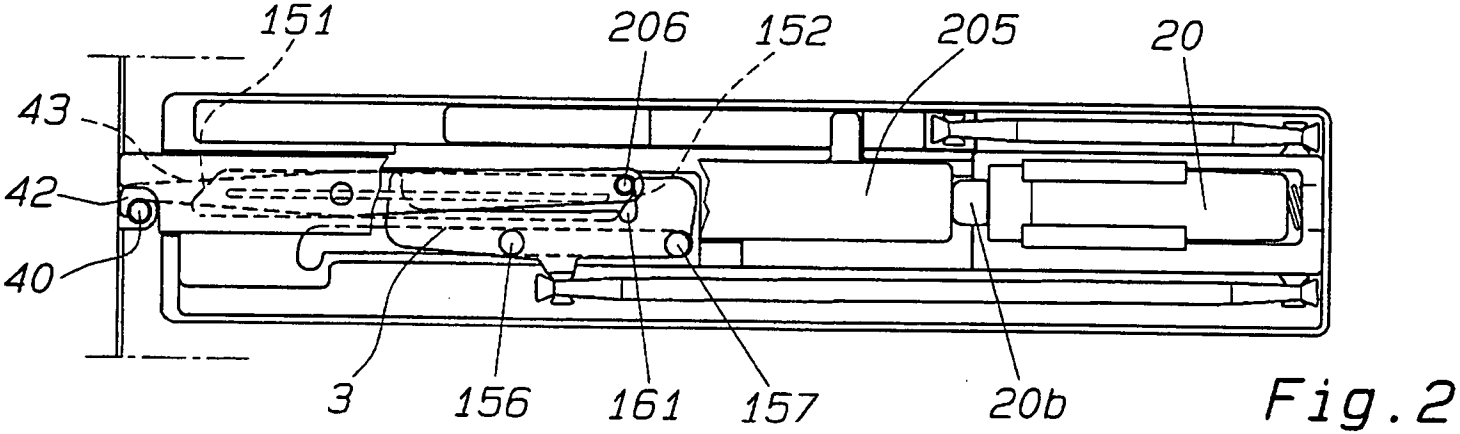
FIG. 2 shows the device in FIG. 1 with the drawing pin disengaged from the rear cavity of the slider.
Figure 3:
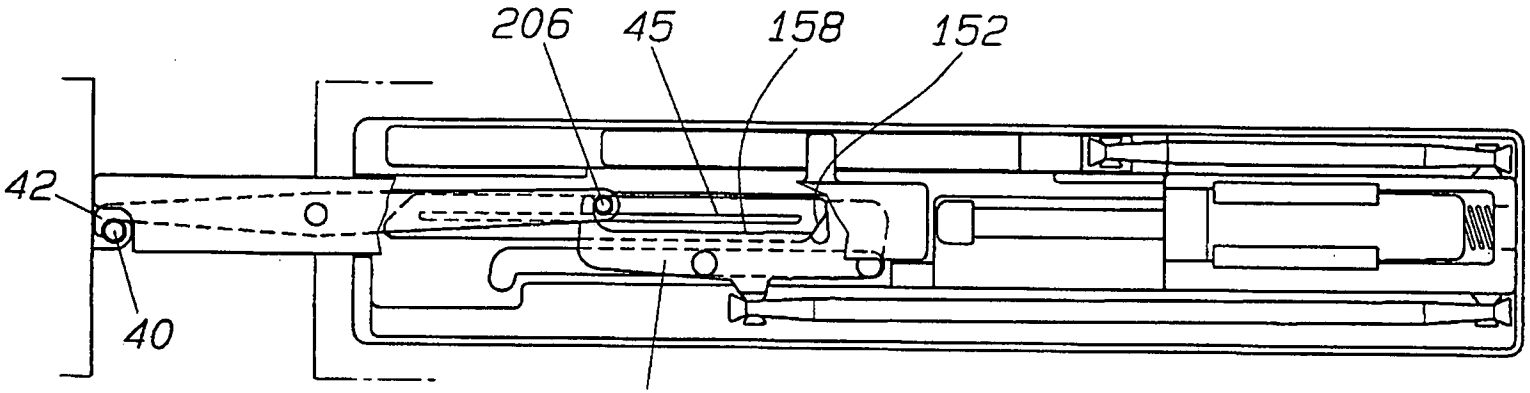
FIG. 3 shows the device in FIG. 1 with the drawing pin abutting against the front edge of the slider, in the position in which the door is opened sufficiently to enable it to be grasped by the user.

As shown in FIG. 2, following the displacement of the drawing element 205, a pressure exerted on the movable part 103 of the furniture unit from the outside induces a withdrawal of the accommodation portion 20 of the ejector in contrast with the stop element 209, that yields elastically. This displacement makes the drawing pin 206 slide transversely along the sloping wall 152 of the track 45, releasing the drawing pin 206 from its seat 161 where it engages with the slider 3, while simultaneously making the hooking element 42 engage with the pin 40 of the movable part 103 of the furniture unit. When the pressure exerted by the user from the outside is released, the spring 5 keeps the slider 3 in its position at the bottom of the groove 204, while the accommodation portion 20 of the ejector returns to its initial position abutting against the fixed stop element 50 and the stem 20*b* is extracted and thus pushes the drawing element 205 with the drawing pin 206 into the position shown in FIG. 3, in which the movable part 103 can be grasped and pulled to open it completely.

Figure 4:
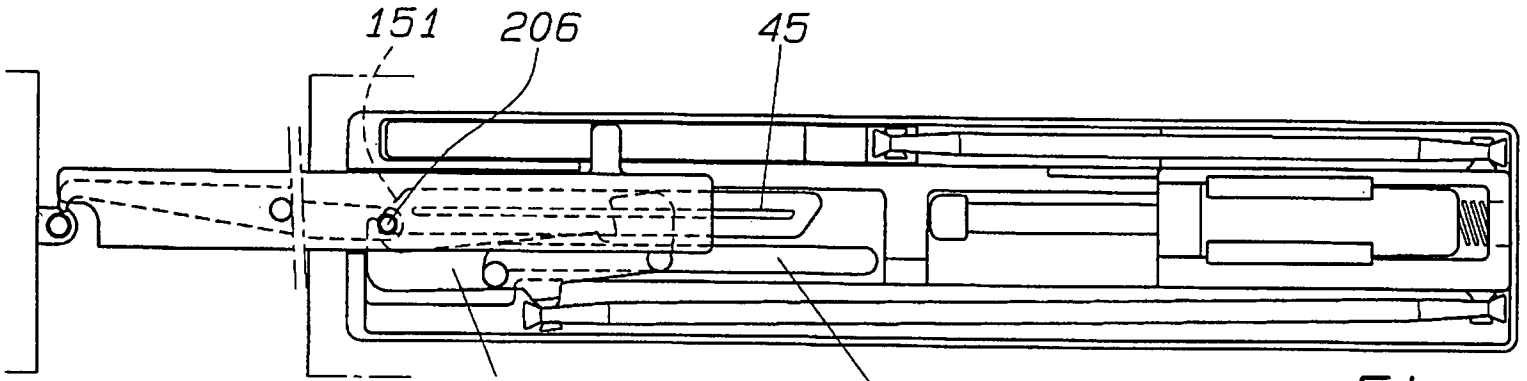
FIG. 4 shows the device in FIG. 1 in which, due to the user exerting a pulling action on the door from the outside, the drawing means are displaced transversely to the direction of their sliding axis until they release the door.

During this opening movement, the drawing pin 206 encounters and pushes against the front edge 159 of the slider 3, which is drawn along the groove 204 into the position shown in FIG. 4, in which the drawing pin 206 slides along the sloping front wall 151 of the track 45. In this position, the slider 3 engages with the guide pin 156 in the front bend 155 in the groove 204 and thus remains locked in its position with the spring 5 loaded, the hooking element 42 is disengaged from the pin 40 and the drawing element 205, together with the drawing pin 206, is pushed backwards due to the effect of its drawing fin 207 being engaged with the slider 101 recalled by the spring 102, that was loaded previously, during the extraction of the drawing element 205.

Figure 5:
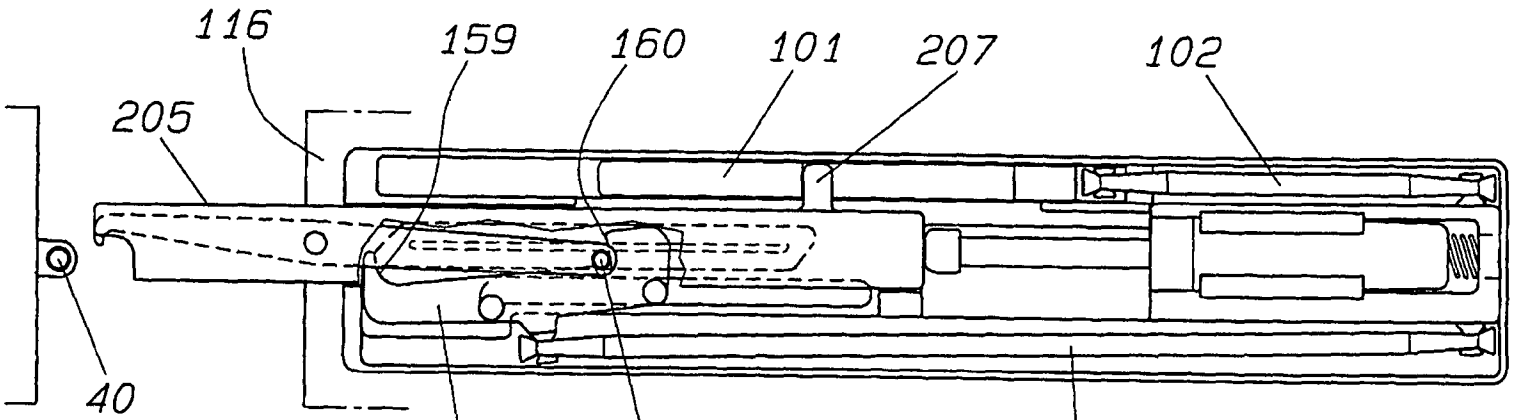
FIG. 5 shows the device in FIG. 1 at the point where, during the retraction of the drawing element, the drawing pin abuts against the edge of the rear cavity of the slider.

In the position shown in FIG. 5, the drawing pin 206 encounters and pushes against the rear edge 160 of the slider 3, which is thus released from its current position and returns, together with the drawing element 205, to the initial position shown in FIG. 6, but with the movable part 103 open. Since the hooking element 42 is raised in this position, the movable part 103 can be closed again normally, by means of the typical closing devices of known type with which it is fitted. Moreover, from its closed position the movable part 103 can also be opened accidentally by pulling it without the device being operated in an anomalous manner, and consequently without it being damaged. The device comprising a magnetic hooking system, shown in FIGS. 12 and 13, is also suitable for movable parts of furniture units fitted with guides or hinges and already complete with independent thrust devices in the opening direction, but it is distinguishable essentially in that the rotation of the lever 43 is exploited only to disengage the drawing pin 206 from the slider, while the drawing element 205 is released from the movable part 103 of the furniture unit when the magnetic connecting force is exceeded by the pulling force exerted by the user and the drawing element 205 is retained at the end of its stroke by the front stop on the slider 101.

It has been demonstrated in practice that the device according to the invention is particularly advantageous in enabling the simple and practical opening and closing of a door or drawer, making it easy for the user to grasp and ensuring a controlled closing action.

The invention thus conceived may undergo numerous modifications and variants, all coming within the scope of the inventive concept; moreover, all the component parts may be replaced with other, technically equivalent components.

In practice, any materials may be used, and in any sizes, according to need and the state of the art.

The invention claimed is:

1. Device (1) for opening and closing a moveable part of a furniture and associated to a fixed part of the furniture (116), the device comprising a body (208) for supporting a slider (3) reversibly sliding along a sliding axis (100) in contrast and due to the action of first elastic means (5), said slider (3) being engageable with drawing means present on a drawing element sliding in the direction of said sliding axis (100) integral or in a manner reversibly couplable with said moveable part (103) of the furniture, said support body (208) comprising first movement means (45) adapted to move said drawing means in such a manner to free said drawing means and said slider (3) from their mutual engagement at the closing position of the movable part of the furniture, further comprising a yielding elastic stop element (209) against which said drawing element (205) directly or indirectly abuts against while being engaged with said drawing means in said first movement means, further comprising thrust means (20, 20*b*) adapted to directly or indirectly push said drawing element (205) in the opposite direction and with a force lower with respect to the action of said first elastic means, the first elastic means (5) being active in the closing direction and the yielding elastic stop element (209) being active in the opening direction of the movable part (103) of the furniture.

2. Device (1) for opening and closing a moveable part of a furniture according to claim 1, wherein said thrust means push said drawing element (205) only for a section of the movement thereof.

3. Device (1) for opening and closing a moveable part of a furniture according to claim 1, wherein said drawing means are supported by said drawing element (205) in a moveable manner transversely to the direction of said sliding axis (100).

4. Device (1) for opening and closing a moveable part of a furniture according to claim 1, wherein said drawing means comprise a drawing pin (206) fixed onto a lever (43) pivoted in an oscillating manner on said drawing element (205).

5. Device for opening and closing a moveable part of a furniture according to claim 4, wherein said first movement means comprise—in a track (45) provided for in the body (208) of said support and guided along which is the free end of said drawing pin (206)—at least one first (151) and one second (152) section of said track (45) transverse to the direction of said sliding axis (100) and connected to a third (153) and a fourth (156) section of said track (45) developing parallel to the direction of said sliding axis (100).

6. Device (1) for opening and closing a moveable part of a furniture according to claim 5, wherein said track (45) comprises two adjacent rails parallel to each other.

7. Device (1) for opening and closing a moveable part of a furniture according to claim 4, wherein said lever (43) bears—on an opposite arm with respect said drawing pin (206)—an element (42) for mechanical engagement with said moveable part (103).

8. Device (1) for opening and closing a moveable part of a furniture according to claim 4, wherein said slider (3) comprises a lowered surface (158) delimited by a front side (159) and a rear side (160) for intercepting said drawing pin (206), said lowered surface (158) further having a rear cavity (161) in which said drawing pin (206) can be engaged in a releasable manner.

9. Device (1) for opening and closing a moveable part of a furniture according to claim 1, further comprising a magnetic element (300) for engaging said drawing element (205) with said moveable part (103).

10. Device (1) for opening and closing a moveable part of a furniture according to claim 1, wherein said support body (208) has a groove (204) which develops in the direction of said sliding axis (100), a front end of the groove having second means for moving said slider (3) in a manner transverse to said sliding axis (100), such means being adapted to be engaged in a releasable manner with guide means of said slider (3).

11. Device (1) for opening and closing a moveable part of a furniture according to claim 10, wherein said second movement means comprise a front curve (155) of said groove (204), and said guide means comprise a front guide pin (156) and a rear guide pin (157) borne fixed by said slider (3) and sliding in said groove (204).

12. Device (1) for opening and closing a moveable part of a furniture according to claim 1, further comprising a second slider (101) borne by said support body (208) and reversibly sliding in the direction of said sliding axis (100) in contrast and due to the action of second elastic means, said second slider (101) being engageable with second drawing means present on said drawing element (205).

13. Device (1) for opening and closing a moveable part of a furniture according to claim 1, wherein said thrust means comprise an ejector comprising a part (20) for accommodating a stem (20*b*) moveable in the direction of said sliding axis (100), wherein said accommodation part (20) is moved by said stop element (20*g*) (209) against a fixed stop element (50) of said support body (208) in such a manner to be able to be retracted in the direction of said sliding axis (100) in contrast to said stop element (209), and wherein said stem (20*b*) is adapted to operate against the rear base of said drawing element (205) to generate an initial travel for opening said moveable part (103).

14. Device (1) for opening and closing a moveable part of a furniture according to claim 13, wherein said stop element (209) is a spring interposed between the rear base of said accommodation part (20) and a bottom wall of a fixed guide (162) along which said accommodation part (20) is moveable.

* * * * *